US005155939A

United States Patent [19]

Pheulpin

[11] Patent Number: 5,155,939

[45] Date of Patent: Oct. 20, 1992

[54] APPARATUS FOR GRINDING CUTTING INSTRUMENTS

[75] Inventor: Jean Pheulpin, Lausanne, Switzerland

[73] Assignee: Arnold Deppeler S.A., Switzerland

[21] Appl. No.: 726,383

[22] Filed: Jul. 5, 1991

[30] Foreign Application Priority Data

Jul. 25, 1990 [CH] Switzerland ..... 2.465/90

[51] Int. Cl.[5] ..... B24B 7/00

[52] U.S. Cl. ..... 51/57; 51/67; 51/59 R

[58] Field of Search ..... 51/57, 59 R, 238 T, 51/157, 158, 159

[56] References Cited

U.S. PATENT DOCUMENTS

| | | | |
|---|---|---|---|
| 1,113,650 | 11/1914 | Kelsey | 51/57 |
| 1,411,713 | 4/1922 | Downing | 51/157 |
| 1,605,784 | 11/1926 | Schmitt | 51/157 |
| 2,165,929 | 4/1937 | Lentz | 51/157 |
| 2,578,081 | 12/1951 | Miller | 51/59 R |
| 3,883,995 | 5/1975 | Ohashi | 51/159 |
| 4,335,544 | 6/1982 | Manson | 51/277 |
| 4,512,111 | 4/1985 | Childers | 51/157 |
| 4,602,531 | 7/1986 | Korhonen | 51/59 R |
| 4,691,481 | 9/1987 | Souch | 51/277 |

*Primary Examiner*—Bruce M. Kisliuk
*Assistant Examiner*—Bo Bounkong
*Attorney, Agent, or Firm*—Silverman, Cass & Singer

[57] ABSTRACT

The instrument to be ground is positioned lying on the brackets of a support, with its longitudinal axis horizontal and parallel to the plane of a base plate of the apparatus. A grinding stone, mounted on a carrier arranged in such manner as to be able to slide on the base plate is moved opposite the end of the blade of the instrument while rubbing lightly against the cutting face of this blade, thus acting to grind that face. The inclination of the grinding stone is adjustable according to the configuration of the instrument, a dial clinometer enabling this inclination to be checked and to determine it as a function of indications which will be furnished, to this end, by the manufacturer of the instrument.

9 Claims, 1 Drawing Sheet

APPARATUS FOR GRINDING CUTTING INSTRUMENTS

BACKGROUND OF THE INVENTION P 1.) Field of the Invention

The present invention relates to a grinding apparatus for cutting instruments having an elongate handle, especially instruments for use in dentistry.

2.) Description of the Prior Art

The grinding of instruments for use in dentistry gives rise to problems insofar as it has to be able to be effected by the dentist or by its technical people, who are not necessarily skilled in this field. Moreover, the apparatus for effecting such grinding must be simple and also permit the grinding of several instruments, which imposes contradictory conditions. Apparatus or machines have been proposed for this purpose which are not entirely satisfactory.

SUMMARY OF THE INVENTION

The object of the present invention is to furnish a grinding apparatus which is simple in its construction and also in its use, and which is much more universal in its applications.

This object is achieved in accordance with the invention due to the fact that the grinding apparatus comprises an abrasive element arranged in such manner as to be able to move in any direction in a plane and a support adapted to receive the instrument to be ground and to maintain said instrument in a position in which a handle thereof is situated substantially in a plane parallel to the plane of movement of the abrasive element, the latter being mounted on a support in such a way that the inclination of its working face with respect to said plane is adjustable, the arrangement being such that with the inclination of said working face being adjusted as a function of the inclination of a cutting face of the instrument with respect to the plane in which said handle is situated when the instrument is placed on the support, a movement of the abrasive element causing its working face to follow said cutting face of the instrument produces the grinding thereof.

The various features of the invention will be apparent from the following description, drawings and claims, the scope of the invention not being limited to the drawings themselves as the drawings are only for the purpose of illustrating ways in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENTS

Figure 1:
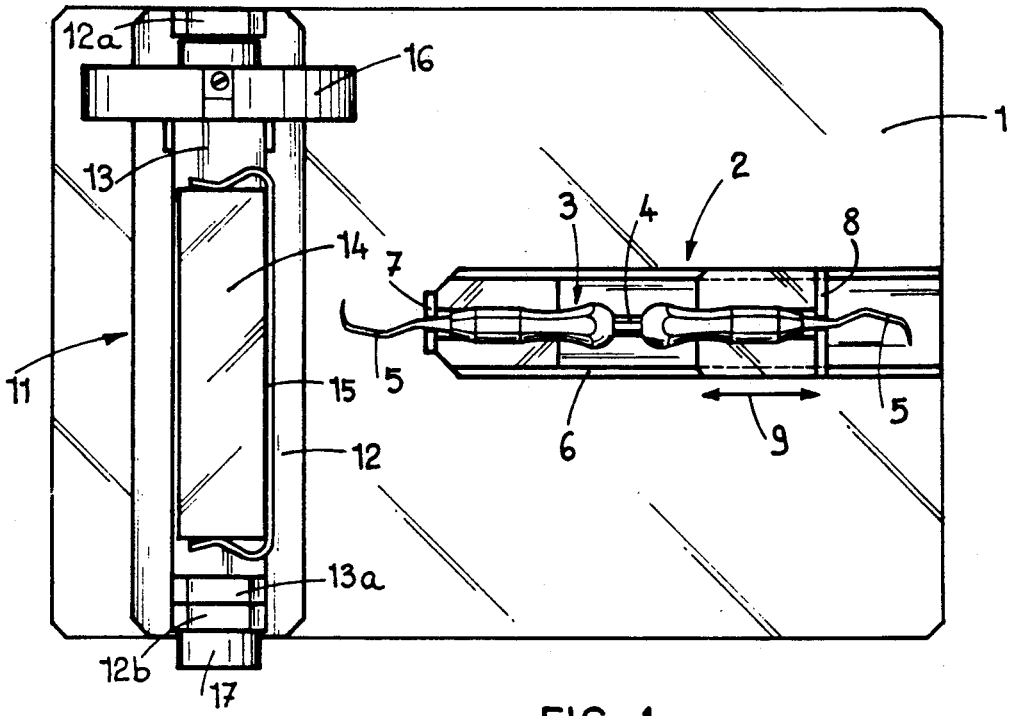
FIG. 1 is a plan view of a grinding apparatus for instruments used in the dental art.

The apparatus described and illustrated comprises a base plate 1, of rectangular shape, on which is secured a support, generally designated by reference 2, intended to receive the instruments to be ground. The latter is constituted, in the example shown, by a tooth scaler 3 comprising an elongate handle 4 with a working blade 5 at each end.

Figure 4:
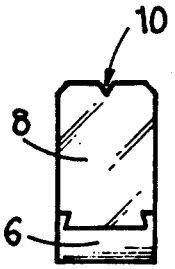
FIG. 4 is a view in elevation of a detail.

The support 2 comprises a slideway 6 secured to the base plate 1 of the apparatus, on which are mounted on the one hand a stationary bracket 7 and on the other hand a movable bracket 8 adjustable along the slideway, that is to say in direction of the arrow 9 in FIG. 1. Each of the brackets 7 and 8 is provided with a V-shaped notch 10, as shown by FIG. 4 which illustrates, in end view, the bracket 8 and the slideway 6.

The longitudinal position of the bracket 8 along the slide having previously been adjusted as a function of the length of the instrument, the instrument is placed on the support, the root of each of its two blades 5 lying in the V-shaped notch of a corresponding one of the brackets 7 and 8. The instrument then occupies a position in which the longitudinal axis of its handle 4 is parallel to the plane of the base plate 1. It is to be noted that, in this embodiment, the instrument can rotate on itself around its longitudinal axis, which can be advantageous for the grinding operations, as it will be indicated hereafter.

The apparatus comprises a grinding unit, generally designated by reference 11, comprising a frame 12 having the shape of a stirrup, the base of which is plane and lies on the base plate 1. The lower face of the base of this frame 12 can, optionally, be provided with an antifriction layer so as to prevent the grinding unit sliding too freely on the base plate 1, a possibility of sliding being however necessary, as will be indicated hereafter.

The grinding unit 11 comprises moreover a support shaped member 13, on which is removably mounted a grinding stone 14 of parallelepipedic general shape, made either from a natural material having a very thin grain, of the type "ARKANSAS" or from an artificial material as a ceramic. This abrasive stone 14 is resiliently pinched between the two ends of an elastic blade 15 cut in a plate **15*a* secured to the support 13. The support is rigid with a dial clinometer 16 by the intermediary of which it is rotatably mounted on one of the arms, designated by 12*a*, of the stirrup shaped frame 12. At the other end, the support 13 is provided with a flange 13*a* rotatably mounted on the second arm, designated by 12*b*, of the stirrup 12. A button 17, screwed on the axis of rotation, designated by 18, of the flange 13*a*, can be tightened to lock the support 13** in position.

Figure 3:
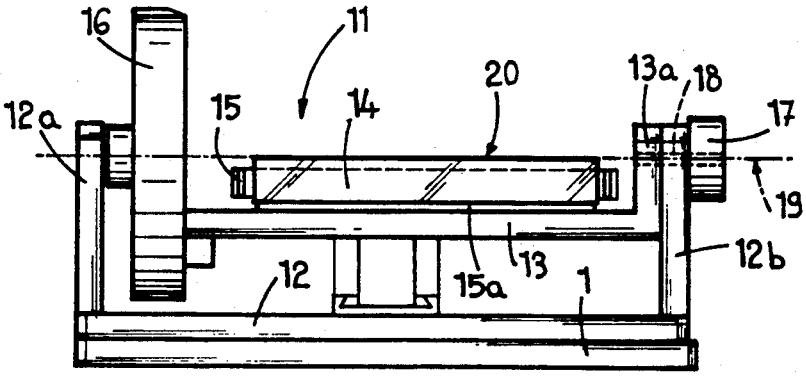
FIG. 3 is an end lateral view thereof.

It is to be noted that the axis of rotation of the support 13 on the stirrup 12, designated by 19 in FIG. 3, passes through the working face, designated by 20 in the same figure, of the abrasive stone 14.

Figure 2:
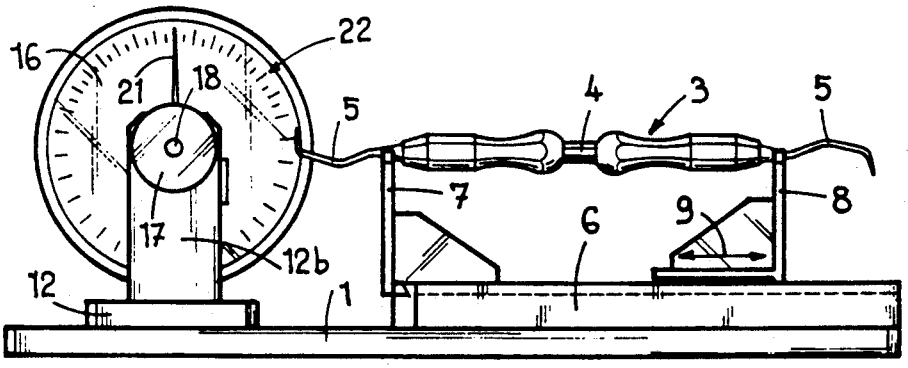
FIG. 2 is a lateral view thereof, in elevation.

The present apparatus is used as follows:

The instrument to be ground being placed on the support 2 as indicated previously, the inclination of the working face 20 of the abrasive stone 14 is adjusted by rocking the support 13 around its axis of rotation 19. The inclination of the support is indicated by the hand, designated by 21 in FIG. 2, of the clinometer relative to which moves a circular graduated scale, designated by 22, of the clinometer.

It is to be noted that the manufacturer of the dental instruments intended to be ground by means of the present apparatus will furnish to its customers tables indicating, for each type of instrument, what is the inclination of the abrasive stone which is suitable for the grinding of this instrument.

This adjustment being effected, the operator with one hand maintains the instrument in position on the support and, with the other hand, moves the grinding stone 14 by sliding the stirrup shaped frame 12 on the base plate 1 of the apparatus whilst urging the stone to exert a slight pressure on the cutting face of the instrument which has to be ground.

During this operation, the user can slightly rotate, about its own axis, the instrument to be ground so that the stone follows the cutting face even when that face is not plane.

It is to be noted that the grinding unit 11 is movable freely in a plane parallel to that of the base plate 1 without having to be guided by any mechanical guiding means ensuring a connection between this base plate and the grinding unit. It is the operator alone who guides the unit 11.

One could provide the arrangement where, for application with instruments the stems of the working blades of which are not of circular section, but of polygonal section, for instance octogonal, the notches of the brackets 7 and 8 are not V-shaped but present two parallel faces surrounding the said stems and thus prevent the instrument rotating on itself. This may be done for the grinding of plane cutting faces as is the case, for instance, with chisels for dental enamel or with chisels for the edges of the gums.

The main elements of the present apparatus can be realized in any suitable material, especially in plastics material.

As a modification, the clinometer 16 could be replaced by a mere index carried by the support of the grinding stone and moving relative to a stationary graduation, for instance.

It is to be noted that the present apparatus can be used for the grinding of cutting instruments other than instruments for use in dentistry.

I claim:

1. A grinding apparatus for grinding an instrument having an elongate handle and a cutting face, said apparatus comprising, a base plate, a support affixed to said base plate and adapted to receive the instrument and maintain the handle generally parallel to the plane of the base plate, an abrasive element having a working face, said element being maintained on a frame, said frame resting on said base plate without securement to the base plate so as to be movable upon the base plate without restriction, means for adjusting the inclination of the working face with respect to said plane, whereby the working face may be set at a selected inclination and engaged against the cutting face and moved with respect thereto to effect grinding of said cutting face.

2. An apparatus as claimed in claim 1 in which the instrument is rotatable about its longitudinal axis on said support.

3. An apparatus as claimed in claim 1 in which the handle has at least a section of non-circular cross sectional configuration, said support engaging the handle so as to prevent any rotative movement of the instrument about its longitudinal axis.

4. An apparatus as claimed in claim 1 including means to set the inclination of said working face with respect to said plane.

5. An apparatus as claimed in claim 4 in which said means to set the inclination include an index and a circular graduated scale, one of said index and scale being stationary and the other being movable and rigid with respect to said frame.

6. An apparatus as claimed in claim 4 in which said means to set the inclination include a clinometer.

7. An apparatus as claimed in claim 1 including locking means to lock the frame in adjusted position.

8. An apparatus as claimed in claim 1 in which the abrasive element is formed as a parallelepipedic abrasive member removably mounted on said frame.

9. An apparatus as claimed in claim 1 in which said support includes two brackets positioned at a distance one from the other, each bracket having a notch, the notches of the brackets being aligned with respect to each other to receive the instrument proximate the ends thereof.

* * * * *